US007416360B2

(12) United States Patent
Tajima

(10) Patent No.: US 7,416,360 B2
(45) Date of Patent: Aug. 26, 2008

(54) CONTAINER WITH APPLICATOR

(75) Inventor: Yoshiaki Tajima, Tokyo (JP)

(73) Assignee: Tokiwa Corporation, Gifu (JP)

( * ) Notice: Subject to any disclaimer, the term of this patent is extended or adjusted under 35 U.S.C. 154(b) by 497 days.

(21) Appl. No.: 10/531,148

(22) PCT Filed: Nov. 29, 2004

(86) PCT No.: PCT/JP2004/017717

§ 371 (c)(1),
(2), (4) Date: Apr. 12, 2005

(87) PCT Pub. No.: WO2005/053457

PCT Pub. Date: Jun. 16, 2005

(65) Prior Publication Data

US 2005/0276655 A1 Dec. 15, 2005

(30) Foreign Application Priority Data

Dec. 2, 2003 (JP) ..... 2003-402570
May 7, 2004 (JP) ..... 2004-138058

(51) Int. Cl.
*A46B 11/04* (2006.01)
*A46B 17/04* (2006.01)

(52) U.S. Cl. ..... 401/280; 401/269; 401/278

(58) Field of Classification Search ..... 401/269, 401/270, 272, 278, 279, 280, 202
See application file for complete search history.

(56) References Cited

U.S. PATENT DOCUMENTS 3,331,094 A * 7/1967 Schwartzman ..... 401/269
4,368,746 A * 1/1983 Spatz ..... 401/202
5,904,433 A * 5/1999 Kay ..... 401/269
6,854,914 B2 * 2/2005 Keating et al. ..... 401/270

FOREIGN PATENT DOCUMENTS

CN 2556991 A 6/2003
JP 59-49649 4/1984

(Continued)

OTHER PUBLICATIONS

Patent Abstracts of Japan, Publication No. 2004-147775 dated May 27, 2004, 1 pg.

(Continued)

*Primary Examiner*—David J Walczak
(74) *Attorney, Agent, or Firm*—Osha Liang LLP

(57) ABSTRACT

A container with an application tool includes a main body having a storage part for storing liquid substances and a neck part having a communicating port connected with the storage part; an application tool head axially movably connected to the neck part; a valve seat connected to the back end of application tool head; a partitioning wall partitioning the communicating port in the neck part; a valve body protruding forward from the partitioning wall having a lead-out hole; and an O-ring elastic member forming a water tight connection between a surface that supports the elastic member on the partitioning wall and the application tool head; wherein the elastic member urges the application tool head to separate the valve seat from the valve body; and the elastic member elastically deforms so that the valve seat contacts the valve body when the application tool head is pressed backward.

20 Claims, 21 Drawing Sheets

FOREIGN PATENT DOCUMENTS

| | | |
|---|---|---|
| JP | H3-33303 | 7/1991 |
| JP | 11-113628 | 4/1999 |
| JP | 2004-147775 | 5/2004 |

OTHER PUBLICATIONS

English Translation of 1st page of Japanese Utility Model, Publication No. H3-33303 dated Jul. 15, 1991, 2 pgs.
Patent Abstracts of Japan, Publication No. 11-113628 dated Apr. 27, 1999, 2 pgs.
English Translation of 1st page of Japanese Utility Model Publication No. 59-49649 dated Apr. 2, 1984, 2 pgs.
International Search Report dated Mar. 15, 2005 for PCT/JP2004/017717, 1 pg.
Chinese Office Action dated Jan. 18, 2008 issued in corresponding Chinese Patent Application No. 200480000791.2, 6 pages.
English Abstract of Chinese Patent No. CN2556991A, 1 page.
Office Action dated May 13, 2008 issued the Japanese Patent Office in Application No. 2005-515921, 7 pages.

* cited by examiner (a)

(b)

(a)

(b)

(a)

(b)

CONTAINER WITH APPLICATOR

TECHNICAL FIELD

The present invention relates to a container with an application tool, and particularly relates to a container with an application tool used for the purpose of storing cosmetics or other such liquid substances and discharging and applying the stored liquid substances.

BACKGROUND ART

An example of a conventional container with an application tool is disclosed in Japanese Utility Model Publication No. 3-33303. When this container is not being used, a cap is attached to the main body of the container, whereby the brush holder and brush case are pushed backward by the urging force of a spring in a joint, and the valve seat is pressed to the distal end of the valve body. The outflow of the cosmetic substance from the cartridge body to the coating body is thereby inhibited. When the container is being used, the cap is removed from the main body, whereby the brush holder and brush case are pushed forward by the urging force of the spring, and the valve seat is released from the valve body. The cosmetic substance thereby flows out of the cartridge body to the coating body.

In this container, an O-ring is also placed between the coupling body and the brush case for the purpose of ensuring that the space between the coupling body and the brush case is watertight.

DISCLOSURE OF THE INVENTION

However, in addition to a valve mechanism containing an O-ring, a valve body, and a valve seat, the conventional container with an application tool described above also requires a spring for urging the brush case in the axial direction, which results in an increased number of components and an ineffective configuration.

In view of this, an object of the present invention is to provide a container with an application tool wherein it is possible to avoid an ineffective configuration by reducing the number of components, and to reduce manufacturing costs.

The container with an application tool according to the present invention comprises a main body comprising a storage part for storing liquid substances and a neck portion having a communicating port that is communicated with the storage part, an application tool head whose back end is inserted in the neck part and that is axially movably connected to the neck part, a valve seat provided to the back end of the application tool head, a partitioning wall that is provided in the neck part and that partitions the communicating port, a valve body for the valve seat that is provided so as to protrude forward from the partitioning wall and that has a lead-out hole for leading out the liquid substances, and a ring-shaped elastic member for water tight provided between the partitioning wall and the application tool head. The elastic member urges the application tool head so that the valve seat separates from the valve body. The elastic member then elastically deforms so that the valve seat is in proximity or in contact with the valve body when the application tool head is pressed backward.

According to such a container with an application tool, the elastic member not only exhibits the function of ensuring that the space between the partitioning wall and the holder is watertight, but also exhibits the function of urging the holder so that the valve seat separates from the valve body. Therefore, the number of components can be reduced to less than when the components that exhibit these functions are provided separately and individually, an ineffective configuration can be avoided, and manufacturing costs can be reduced.

The application tool head preferably has a cylindrical holder, a coating member held in the holder, and a pipe member whose back part is fitted into the holder and whose front part is inserted into the coating member. The valve seat is preferably provided to the back part of the pipe member. Liquid substances are thereby supplied to the coating member through the pipe member.

The container with an application tool preferably further comprises a cap that has an engaging part for pushing the application tool head backward and that is attached to the neck part of the main body. The elastic member preferably elastically deforms so that the valve seat is in proximity or in contact with the valve body due to the application tool head being pushed backward by the engaging part when the cap is attached to the neck part. The elastic member preferably returns to the original state and the valve seat separates from the valve body when the cap is removed from the neck part. The valve mechanism can thereby be automatically opened and closed by attaching and removing the cap.

The thickness of the elastic member in the direction along the central axis is preferably greater than the thickness in the direction perpendicular thereto. Particularly, the elastic member preferably has a substantially elliptical cross section. Alternatively, a circular groove is preferably formed in at least one of the inner peripheral surface and the outer peripheral surface of the elastic member. A greater degree of freedom is thereby achieved in selecting the materials for forming the elastic member, because the distance over which the application tool head moves can be increased.

The container with an application tool preferably comprises a protrusion provided in continuity with the top of the surface on the partitioning wall that supports the elastic member. The elastic member is thereby reliably collapsed around its entire circumference, and it is possible to more sufficiently ensure that the space between the partitioning wall and the application tool head will be watertight.

The neck part preferably has a stopper that prevents the application tool head from being released from the neck part. The application tool head is thereby prevented from being released from the neck part, and it is possible to more sufficiently ensure that the space between the partitioning wall and the application tool head will be watertight.

The present invention can be more sufficiently understood with the aid of the following detailed description and the accompanying drawings. These are given merely as examples, and should not be construed as limiting the present invention.

According to the container with an application tool according to the present invention, it is possible to avoid an ineffective configuration by reducing the number of components, and the effects of reducing manufacturing costs can be reliably achieved.

LIST OF ELEMENTS

Figure 1:
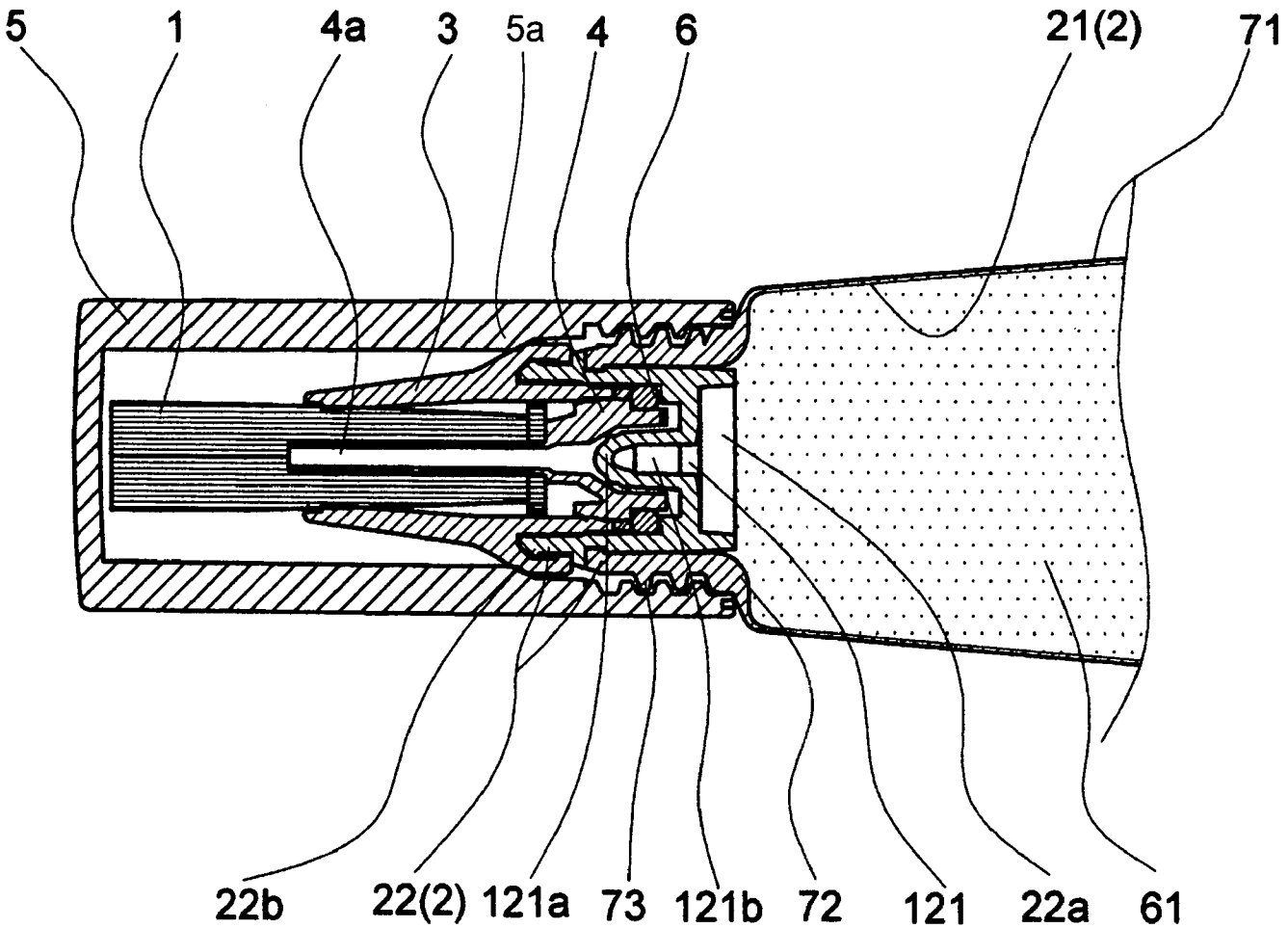
FIG. 1 is a longitudinal sectional view showing the entire configuration of the container with an application tool according to Embodiment 1 of the present invention (when the cap is attached)

1 brush
2 main body
3 holder
3*a* holding hole
3*b* protruding stub
4 pipe member
4*a* through-hole
4*b* valve seat
5 cap
6 ring-shaped elastic member
7 ring-shaped elastic member
16 ring-shaped elastic member
16*a* groove
16*b* side wall part
17 ring-shaped elastic member
17*a* groove
18 ring-shaped elastic member
18*a* groove
21 storage part
22 neck part
22*a* communicating port
22*b* connecting member
22*c* stopper
61 liquid cosmetic substance
71 cylindrical case part
72 shoulder part
73 neck
121 partitioning wall
121*a* valve body
121*b* lead-out hole
121*c* protruding stub

BEST MODE FOR CARRYING OUT THE INVENTION

The embodiments of the present invention will now be described in detail based on the accompanying drawings.

A case will be described in which the present invention is used for the purpose of applying cosmetics including foundations, blushes, essences, and other such liquid cosmetic substances, but the present invention is not limited to these examples, and the following descriptions also apply to cases in which the present invention is used for the purpose of applying liquid products in the form of food articles, ink for writing tools, liquid medical goods, and other products.

Embodiment 1

Figure 2:
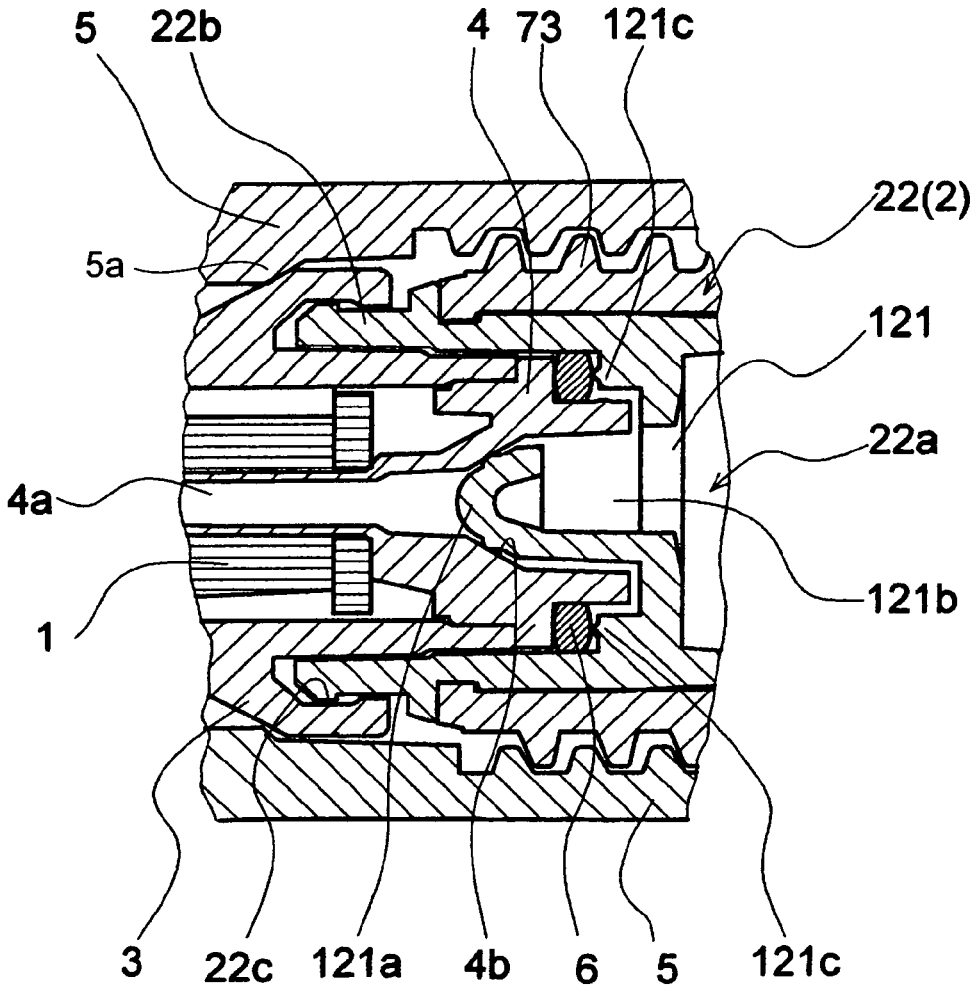
FIG. 2 is a longitudinal sectional view showing a partial configuration of the same container (when the cap is attached)
Figure 3:
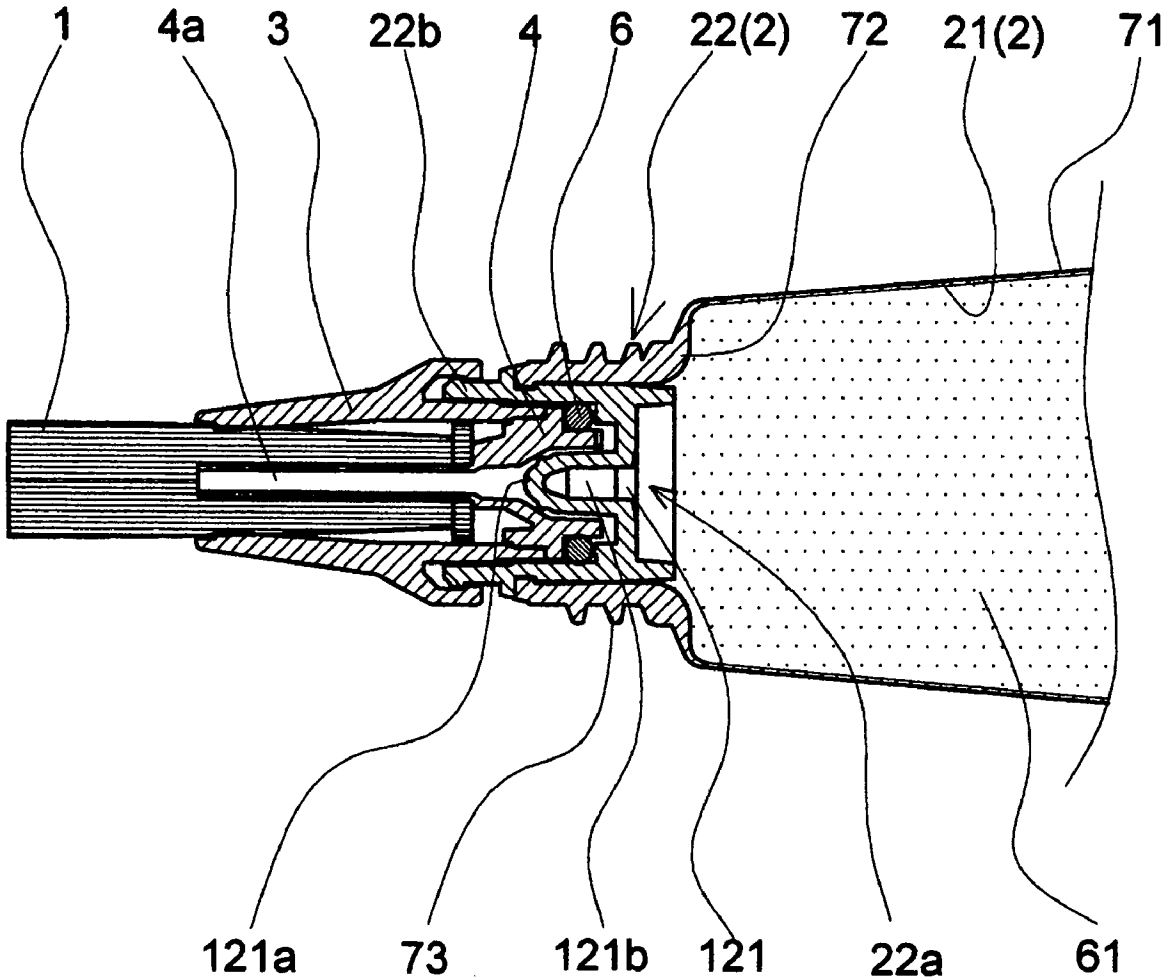
FIG. 3 is a longitudinal sectional view showing the entire configuration of the same container (when the cap is removed)
Figure 4:
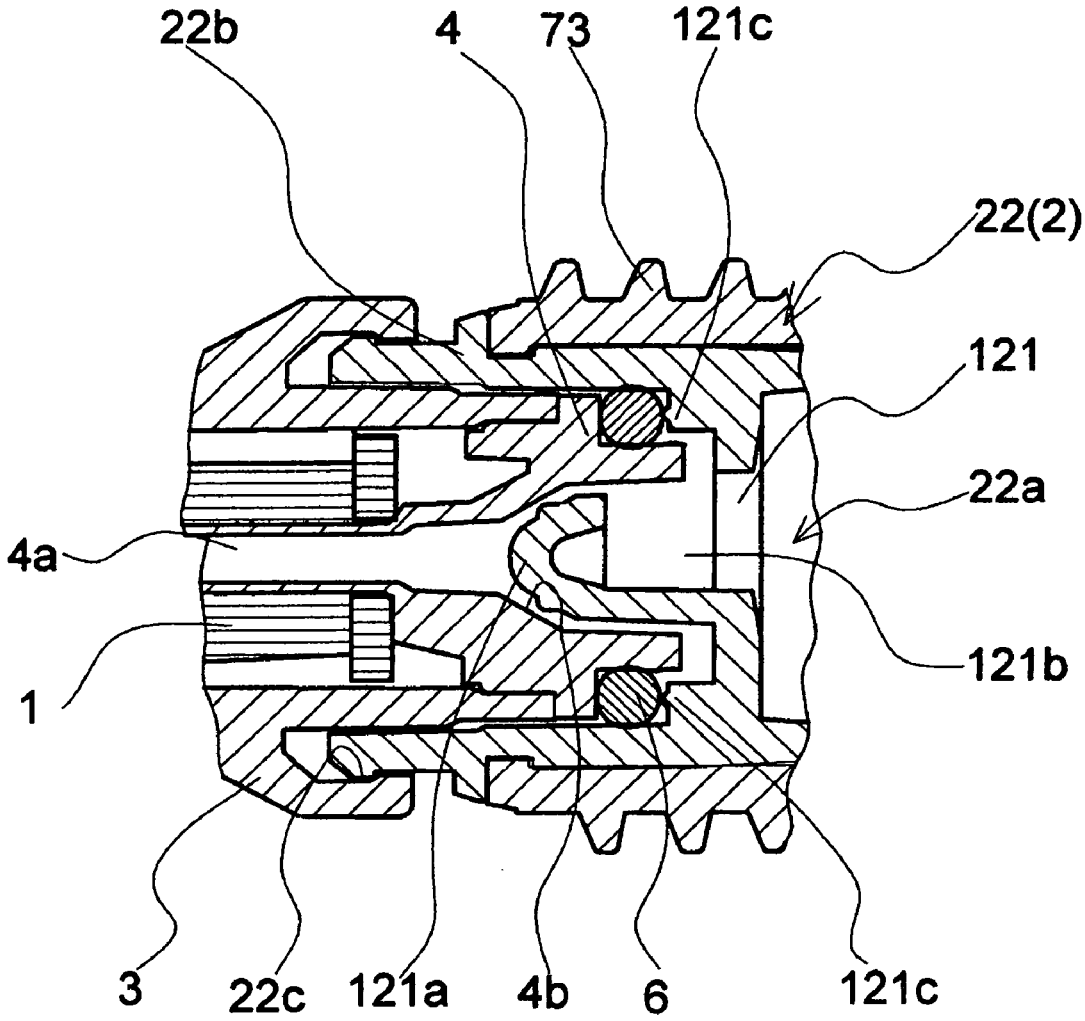
FIG. 4 is a longitudinal sectional view showing a partial configuration of the same container (when the cap is removed)
Figure 5:
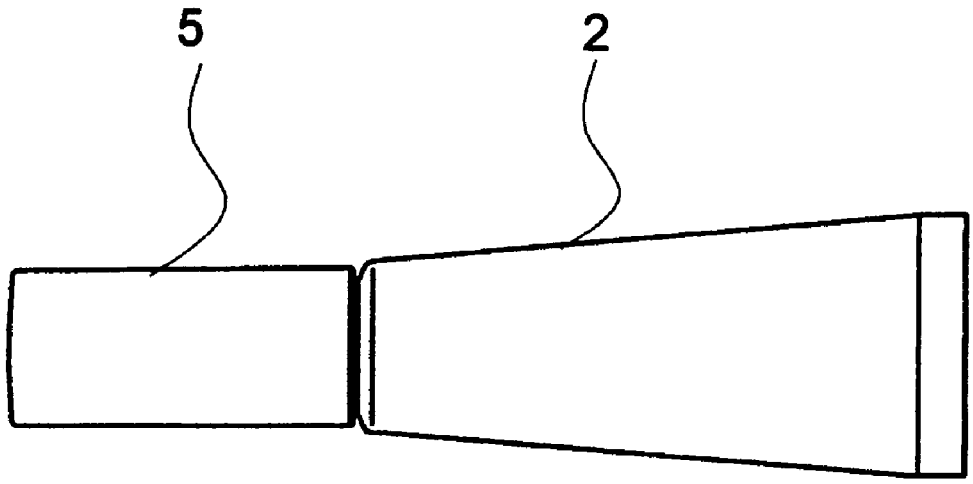
FIG. 5 is a front view showing the external configuration of the same container when the cap is attached and when the cap is removed.
Figure 5:
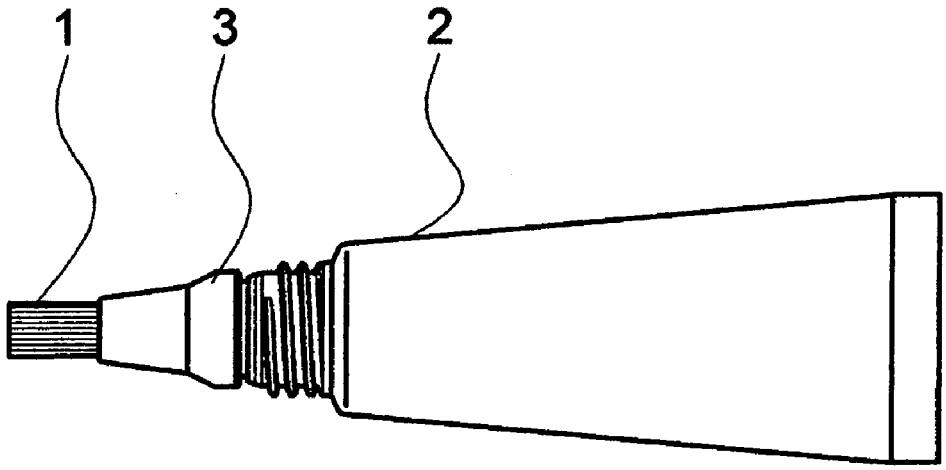

FIG. 1 is a longitudinal sectional view showing the entire configuration of the container with an application tool according to Embodiment 1 of the present invention (when the cap is attached), FIG. 2 is a longitudinal sectional view showing a partial configuration of the same container (when the cap is attached), FIG. 3 is a longitudinal sectional view showing the entire configuration of the same container (when the cap is removed), FIG. 4 is a longitudinal sectional view showing a partial configuration of the same container (when the cap is removed), and FIG. 5 is a front view showing the external configuration of the same container when the cap is attached and when the cap is removed.

The container with an application tool is used for the purpose of storing liquid cosmetic substances and discharging and applying the stored liquid cosmetic substances.

The container with an application tool includes an application tool head, a main body 2, a cap 5, and a ring-shaped elastic member 6, as shown in FIGS. 1 and 2. The application tool head has a brush 1 as a coating member, a holder 3, and a pipe member 4.

These structural elements will now be described in further detail.

(1) Brush 1

The brush 1 is configured to fulfill the role of directly applying a liquid cosmetic substance 61 ejected from the main body 2 to a coating location.

In Embodiment 1, the brush 1 is configured so as to be capable of being mounted in an appropriate location on the neck part 22 as shown in FIGS. 1 through 4.

Specifically, the brush 1 is mounted on the cylindrical neck part 22 with the aid of the cylindrical holder 3, as shown in these drawings.

In other words, the brush 1 is provided such that the rear side is held in place in the interior of the holder 3, the front side protrudes forward from the holder 3, and the liquid cosmetic substance 61 can be applied by the portion protruding from the holder 3.

(2) Main Body 2

The main body 2 is configured with a storage part 21 in which the liquid cosmetic substance 61 is stored, and a neck part 22 having an internal space for ejecting the liquid cosmetic substance 61, as a communicating port 22*a* that is communicated with the interior of the storage part 21, as shown in FIGS. 1 through 4.

In Embodiment 1, the main body 2 has a cylindrical case part 71 with the bottom at the back end, a shoulder part 72 inclined from the case part 71 towards the neck part 22, and a cylindrical neck part 22 protruding from the shoulder part 72 towards the front, as shown in these drawings.

The neck part 22 protrudes from the shoulder part 72 towards the front and has a cylindrical neck 73 molded integrally with the shoulder part 72, and a cylindrical connecting member 22*b* that meshes with the neck 73.

Figure 6:
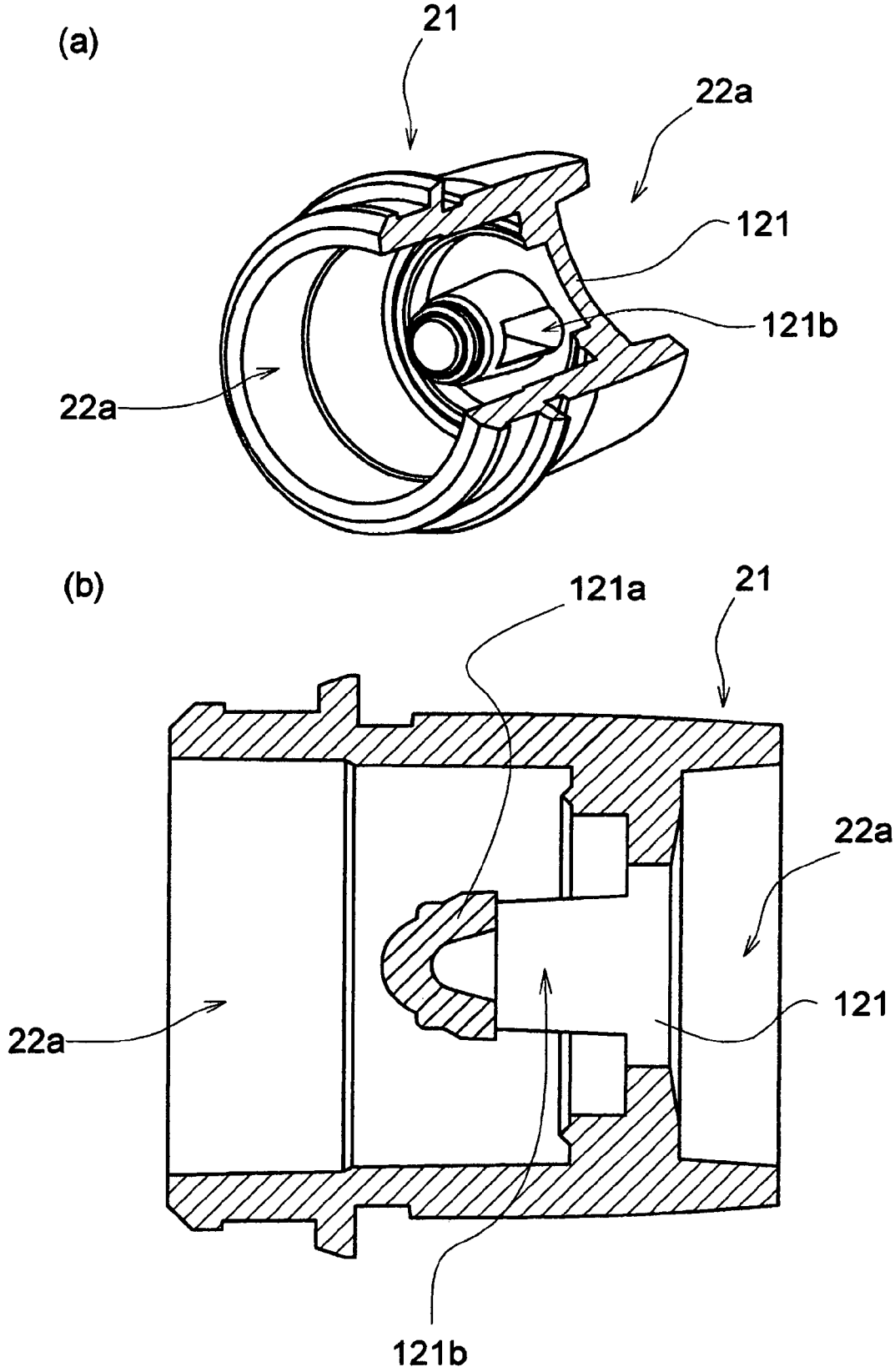
FIG. 6 is a perspective view and a longitudinal sectional view showing the detailed configuration of a connecting member in the same container.

Specifically, a partitioning wall 121 that partitions the communicating port 22*a* lengthwise is formed in the connecting member 22*b*, as shown in FIGS. 6, 2, and 4. This partitioning wall 121 supports a dome-shaped valve body 121*a* protruding towards the front. A lead-out hole 121*b* for leading out the liquid cosmetic substance 61 is provided to the side wall of the valve body 121*a*.

Specifically, this partitioning wall 121 makes it possible to prevent liquid substances from leaking when the cap 5 is attached to the main body 2 by moving the holder 3 to a position wherein a valve seat 4*b* described later is in proximity or in contact with the valve body 121*a*.

The partitioning wall 121 also has a protrusion 121*c* that sinks in around the entire periphery of the ring-shaped elastic member 6 when the cap 5 is attached to the main body 2, as shown in these drawings.

It is thereby possible to more efficiently ensure that the space between the partitioning wall 121 and the holder 3 will be watertight. As a result, accidental circumstances in which the ring-shaped elastic member 6 is not reliably collapsed around the entire periphery can be effectively avoided.

A stopper 22*c* that locks the holder 3 is formed in the distal outer surface of the connecting member 22*b* as shown in FIGS. 2 and 4, so that the holder 3 will not be released from within the connecting member 22*b* when the cap 5 is removed. A locking part formed in a circular fashion on the outer surface of the holder 3 is locked to prevent the holder 3 from being released from the connecting member 22*b*, due to the presence of the stopper 22*c*.

Because of such a stopper 22*c*, the ring-shaped elastic member 6 is set to a thickness at which it can be sandwiched between the pipe member 4 fitted into the holder 3 in contact with the stopper 22*c* and the partitioning wall 121, whereby it is possible to ensure that the space between the partitioning wall 121 and the holder 3 will be watertight even when the cap 5 is attached to the main body 2 as well as when the cap 5 is removed.

(3) Holder 3

The holder 3 has a function of holding the brush 1, as shown in FIGS. 1 through 4. The back end of the holder 3 is inserted into the connecting member 22*b*, and the holder 3 is axially movably connected to the connecting member 22*b*.

Figure 7:
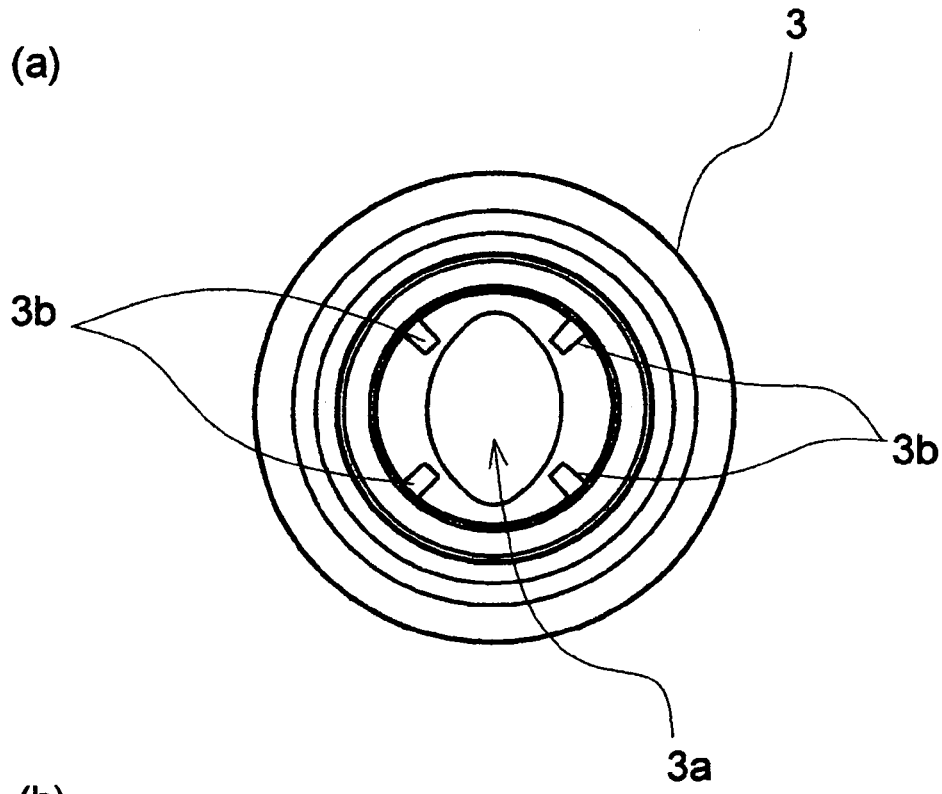
FIG. 7 is a right side view and a longitudinal sectional view showing the detailed configuration of a holder in the same container.
Figure 7:
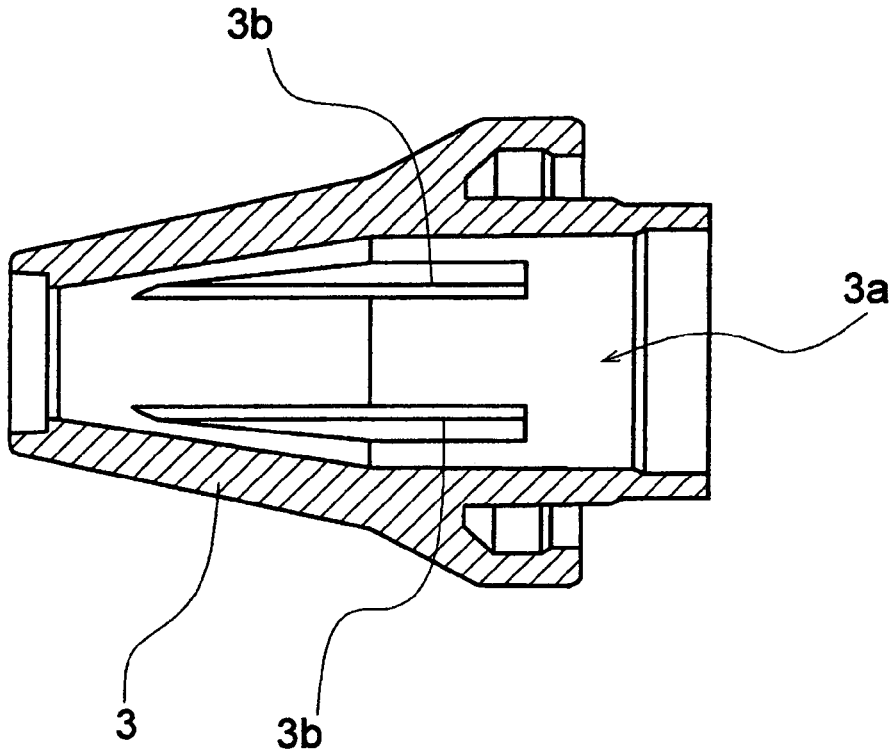

Specifically, the holder 3 has a holding hole 3*a* for holding the brush 1, communicated with the communicating port 22*a*, as shown in FIG. 7. A plurality of protrusions 3*b* that protrude inward and extend in the axial direction are formed along the circumferential direction on the inner periphery of the holding hole 3*a* as shown in these drawings, and it is possible to hold the brush 1 by fixing it between the protrusions 3*b*.

(4) Pipe Member 4

The pipe member 4 has an internally disposed through-hole 4*a* that is communicated with the communicating port 22*a*, as shown in FIGS. 1 through 4, and is configured such that the back part is fitted into the holder 3 and the front part is inserted into the brush 1.

Figure 8:
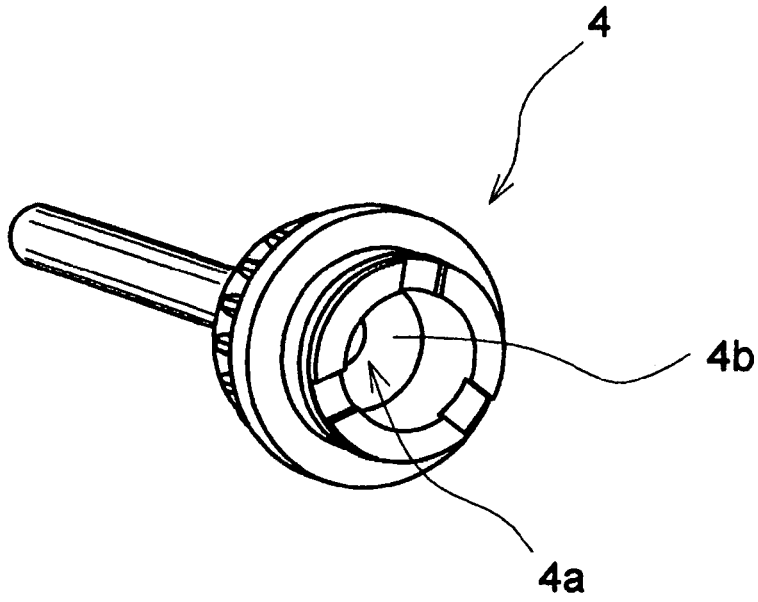
FIG. 8 is a perspective view and a longitudinal sectional view showing the detailed configuration of a pipe member in the same container.
Figure 8:
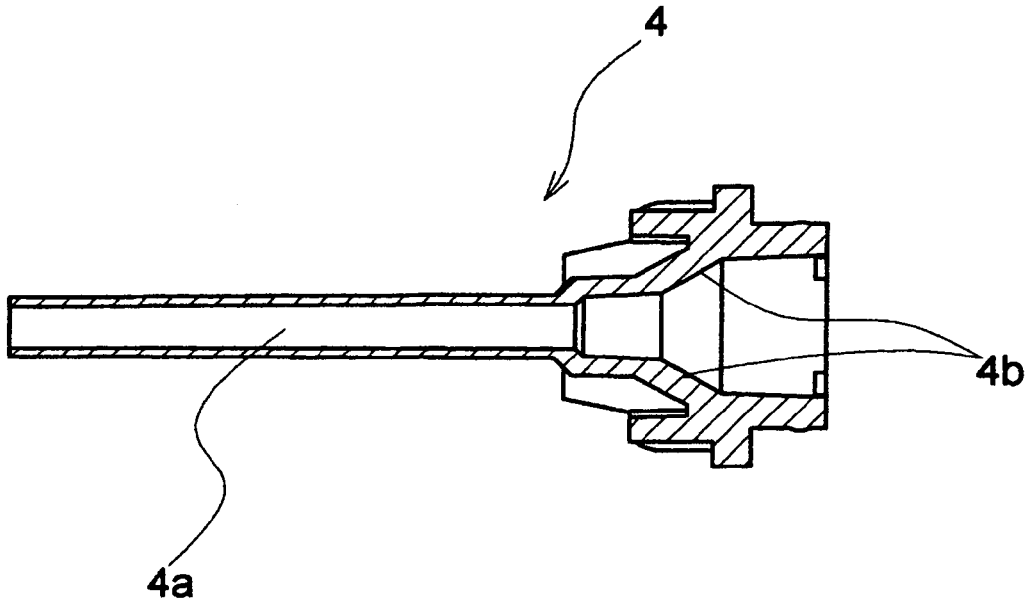

The valve seat 4*b* that faces the valve body 121*a* is formed in the inner periphery of the pipe member 4 in the back part, as shown in FIGS. 8, 2, and 4. Specifically, the valve seat 4*b* is configured to form an opening part that opens toward the valve body 121*a*.

This valve seat 4*b* makes it possible to prevent the liquid cosmetic substance 61 from leaking when the cap 5 is attached to the main body 2 by moving the holder 3 to a position wherein the valve seat 4*b* is in proximity or in contact with the valve body 121*a* previously described.

(5) Cap 5

The cap 5 is configured to be attached to the main body 2 so as to cover the brush 1, as shown in FIGS. 1 and 5A.

Specifically, the cap 5 is configured to be attached to the neck 73 of the main body 2 by being screwed on, as shown in FIGS. 5A and 5B.

Specifically, attaching this cap 5 to the main body 2 makes it possible to push the holder 3 backward by means of an engaging part 5*a* provided to the inner periphery, whereby it is possible to move the holder 3 to a position wherein the valve seat 4*b* is in proximity or in contact with the valve body 121*a*.

In Embodiment 1, the cap 5 is attached to the neck 73 by being screwed on, and the ring-shaped elastic member 6 is therefore configured to exhibit a function of increasing the rotational resistance when the cap 5 is screwed onto the neck 73 by means of the force whereby the member is returned to the original shape.

(6) Ring-Shaped Elastic Member 6

The ring-shaped elastic member 6 is configured to be stored in the connecting member 22*b*, and is formed into a ring shape along the inner peripheral direction of the connecting member 22*b*, as shown in FIGS. 1 through 4.

Specifically, the ring-shaped elastic member 6 is configured to be collapsed around its entire circumference between the partitioning wall 121 and the pipe member 4 when the cap 5 is attached to the main body 2, as shown in FIGS. 1 and 2.

An O-ring manufactured from synthetic rubber is used as the ring-shaped elastic member 6 of Embodiment 1, but the elastic member is not limited thereto, and a member of a different material or name may be used as long as it exhibits the same function.

Specifically, such a ring-shaped elastic member 6 is collapsed around its entire circumference between the partitioning wall 121 and the pipe member 4 when the cap 5 is attached to the main body 2 to make it possible to ensure that the space between the partitioning wall 121 and the holder 3 will be watertight.

It is apparent that the elastic member is not limited to being collapsed between the partitioning wall 121 and the pipe member 4, and as long as the space between the partitioning wall 121 and the holder 3 can be ensured to be watertight, the elastic member may be collapsed between the partitioning wall 121 and the holder 3, or it also may be collapsed between the partitioning wall 121 and both the holder 3 and the pipe member 4.

Additionally, the ring-shaped elastic member 6 is configured to move the holder 3 to a position where the valve seat 4*b* is separated from the valve body 121*a* by the force whereby the member is returned to the original shape when the cap 5 is removed from neck 73, as shown in FIGS. 3 and 4.

Specifically, such a ring-shaped elastic member 6 makes it possible to remove the seal designed to prevent liquid substances from leaking through the lead-out hole 121*b* of the valve body 121*a* by moving the holder 3 to a position where the valve seat 4*b* is separated from the valve body 121*a* when the cap 5 is removed from neck 73.

Also, the ring-shaped elastic member 6 in Embodiment 1 makes it possible to ensure that the space between the partitioning wall 121 and the holder 3 will be watertight merely by being held around its entire circumference between the partitioning wall 121 and the pipe member 4.

The ring-shaped elastic member 6 herein is set to a thickness whereby it can be held between the partitioning wall 121 and the pipe member 4 fitted into the holder 3 in contact with the stopper 22*c* (see FIGS. 3 and 4).

In other words, since the stopper 22*c* that comes into contact with the holder 3 is formed on the connecting member 22*b* so as not to be released from within the connecting member 22*b* when the cap 5 is removed from the neck 73, such a ring-shaped elastic member 6 makes it possible to ensure that the space between the partitioning wall 121 and the holder 3 will be watertight not only when the cap 5 is removed from the neck 73, but also when the cap 5 is attached to the main body 2. As a result, an effective configuration can be obtained in a more complete form.

As a result of using such a ring-shaped elastic member 6, the cap 5 in Embodiment 1 is attached to the neck 73 by being screwed on, and the ring-shaped elastic member 6 therefore fulfills the role of increasing the rotational resistance when the cap 5 is screwed onto the neck 73 by the force whereby the member is returned to the original shape.

As described above, the container with an application tool in Embodiment 1 comprises a ring-shaped elastic member 6 that not only exhibits the function of ensuring that the space between the partitioning wall 121 and the holder 3 is watertight, but also exhibits the function of moving the holder 3 to a position where the valve seat 4*b* is separated from the valve body 121*a* when the cap 5 is removed from the neck 73.

Consequently, the number of components can be reduced compared to when components that exhibit these functions are provided separately and individually, an ineffective configuration can be avoided, and manufacturing costs can be reduced.

Embodiment 2

Figure 9:
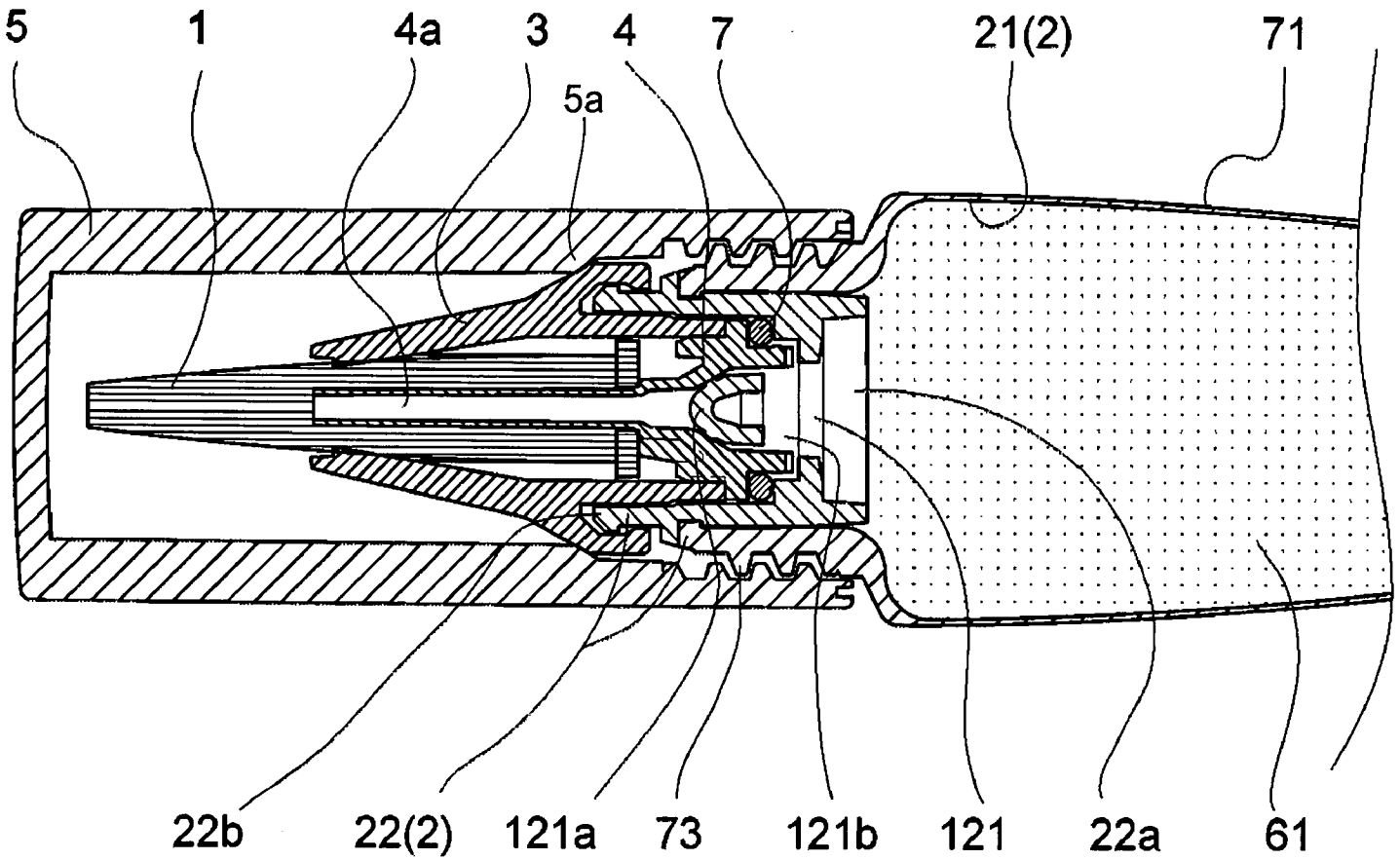
FIG. 9 is a cross-sectional view showing the entire configuration of the container with an application tool according to Embodiment 2 of the present invention (when the cap is attached)
Figure 10:
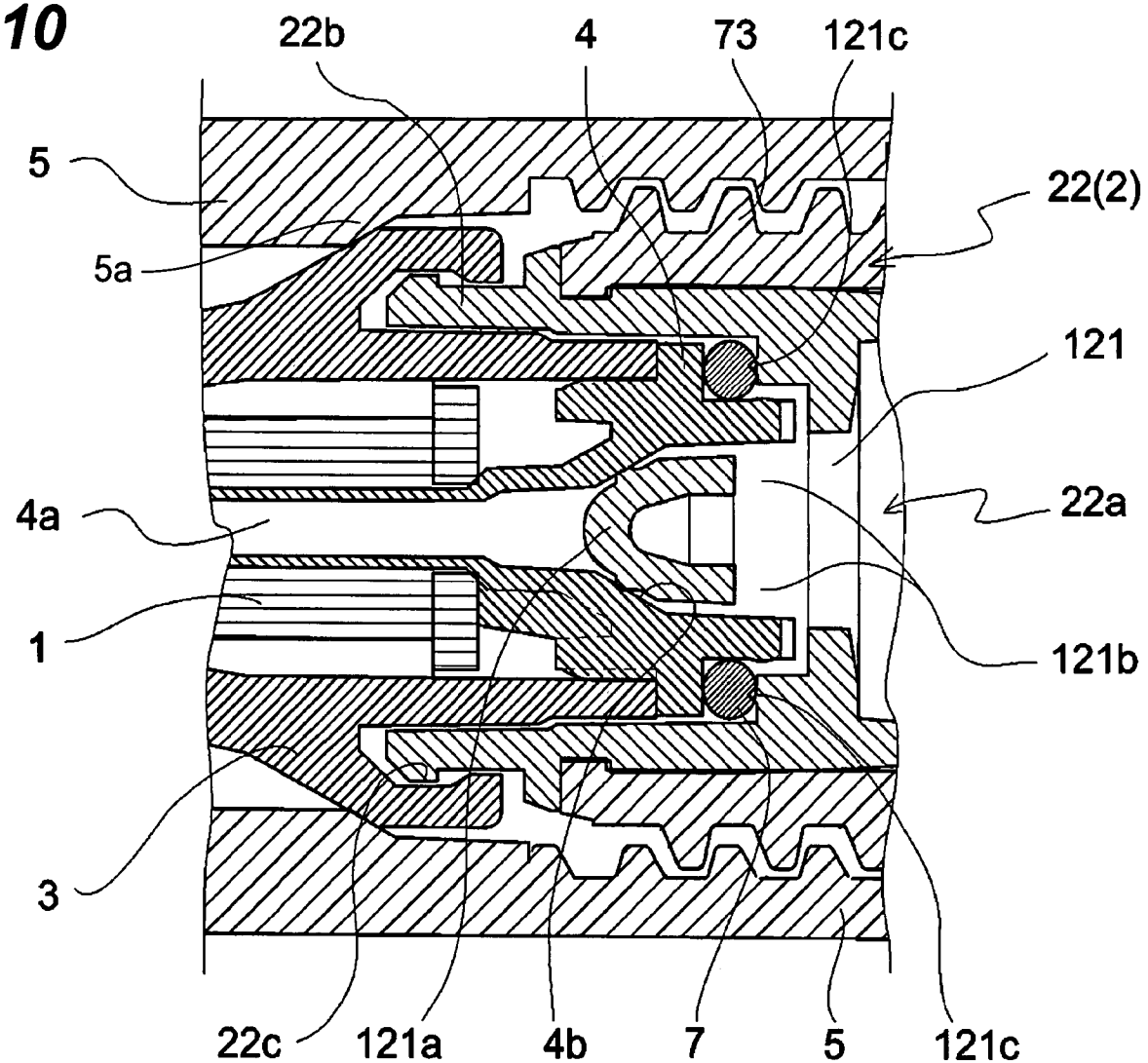
FIG. 10 is a cross-sectional view showing a partial configuration of the same container (when the cap is attached)
Figure 11:
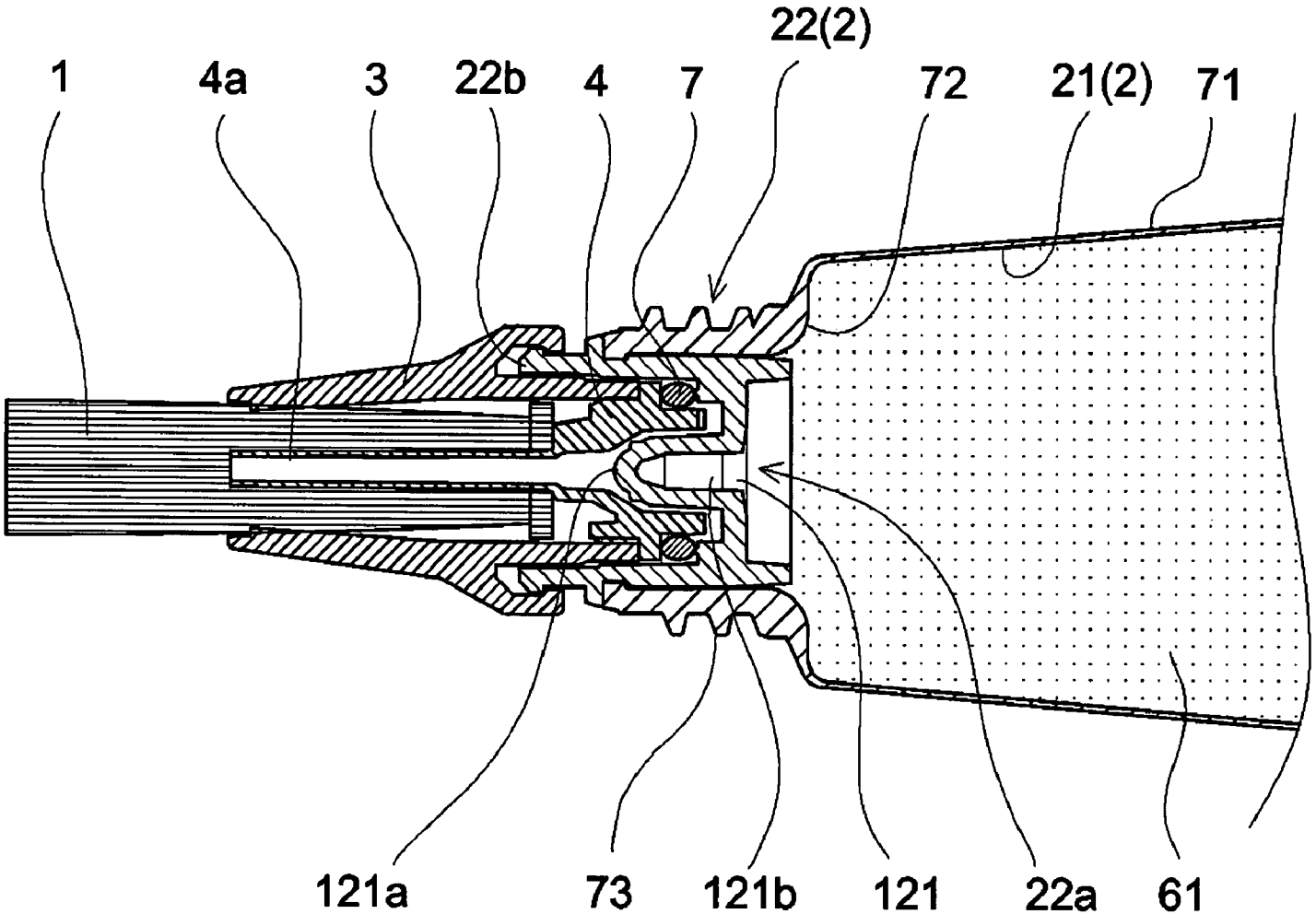
FIG. 11 is a cross-sectional view showing the entire configuration of the same container (when the cap is removed)
Figure 12:
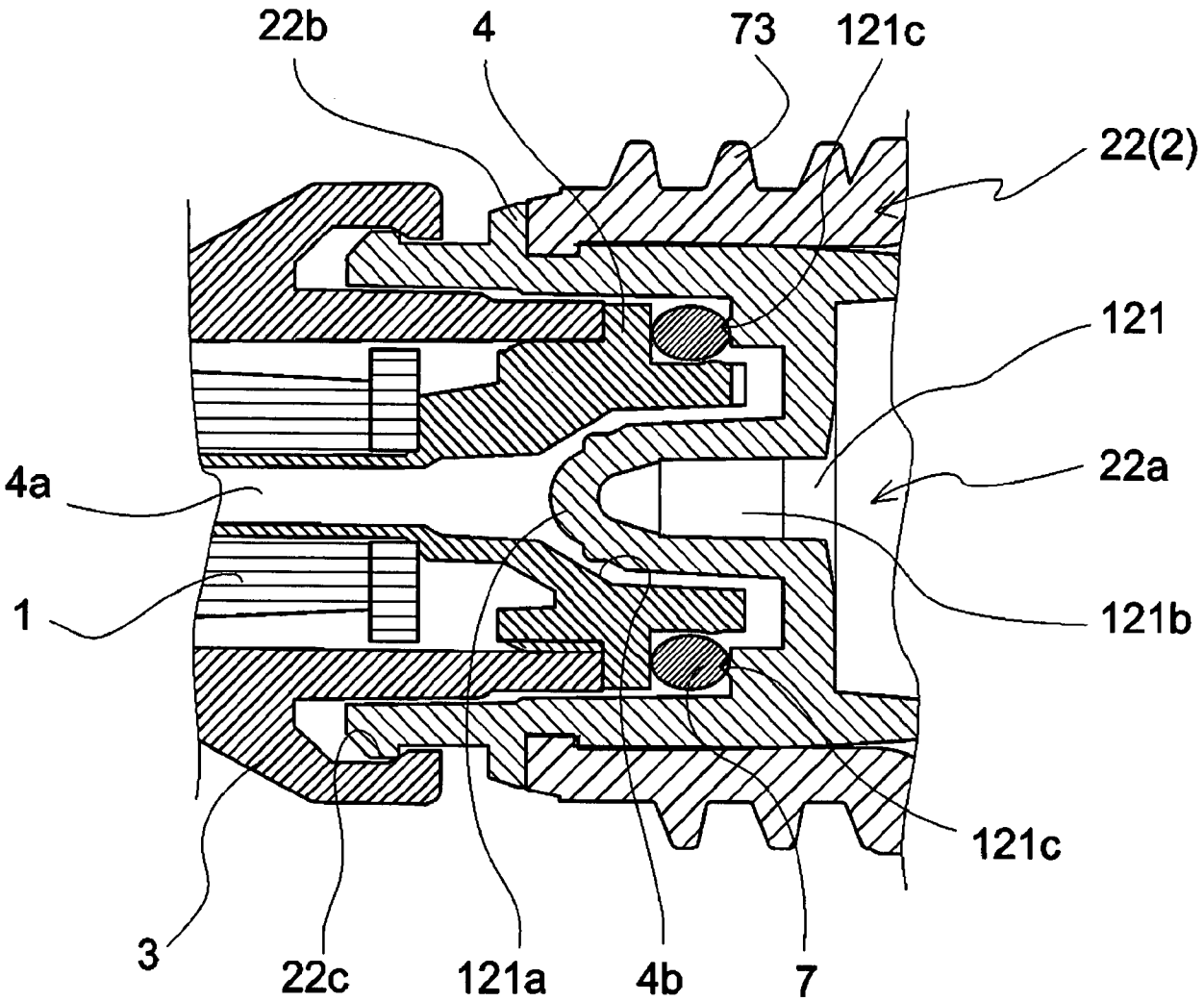
FIG. 12 is a cross-sectional view showing a partial configuration of the same container (when the cap is removed)

FIG. 9 is a cross-sectional view showing the entire configuration of the container with an application tool according to Embodiment 2 of the present invention (when the cap is attached), FIG. 10 is a cross-sectional view showing a partial configuration of the same container (when the cap is attached), FIG. 11 is a cross-sectional view showing the entire configuration of the same container (when the cap is removed), and FIG. 12 is a cross-sectional view showing a partial configuration of the same container (when the cap is removed).

Structural elements similar to those in Embodiment 1 are denoted by the same symbols as in Embodiment 1, and detailed descriptions thereof are omitted herein.

The container with an application tool in Embodiment 2 has a different configuration from Embodiment 1 in that it comprises a ring-shaped elastic member 7 that has a special cross-sectional shape, as shown in FIGS. 9 through 12.

The ring-shaped elastic member 7 herein has a substantially elliptical shape around its entire circumference as its cross-sectional shape. More specifically, the ring-shaped elastic member 7 has a cross-sectional elliptical shape around its entire circumference, wherein the major axis is along with the center axis direction, and the minor axis is along with the direction perpendicular thereto.

The reason that the ring-shaped elastic member 7 herein is required to be formed into a cross-sectional elliptical shape is that a container with an application tool wherein an effective configuration can be obtained with a ring-shaped elastic member 7 capable of being manufactured with a wider range of materials is made possible by forming the ring-shaped elastic member 7 into a shape that allows the distance over which the holder 3 moves to be markedly increased. Therefore, a ring-shaped elastic member that has a cross-sectional elliptical shape similar to the cross-sectional rectangular shape that is longer in the center axis direction, or a ring-shaped elastic member that has another cross-sectional elliptical shape that is longer in the center axis direction, may be used in place of the ring-shaped elastic member 7 that has a cross-sectional elliptical shape that is longer in the center axis direction, as long as this elastic member fulfills such roles.

Specifically, instead of a ring-shaped elastic member composed of synthetic rubber, which is a general-purpose product, it is possible to use one that can be manufactured from a relatively hard material previously believed to be unsuitable for providing a sufficient distance for the movement of the holder in a cross-sectional elliptical shape. The ring-shaped elastic member can thus be manufactured from a wider range of materials.

Specifically, the container with an application tool according to Embodiment 2 not only makes it possible to merely obtain an effective configuration, but also makes it possible to obtain an effective configuration with a ring-shaped elastic member that can be manufactured from a wider range of materials.

Embodiment 3

Figure 13:
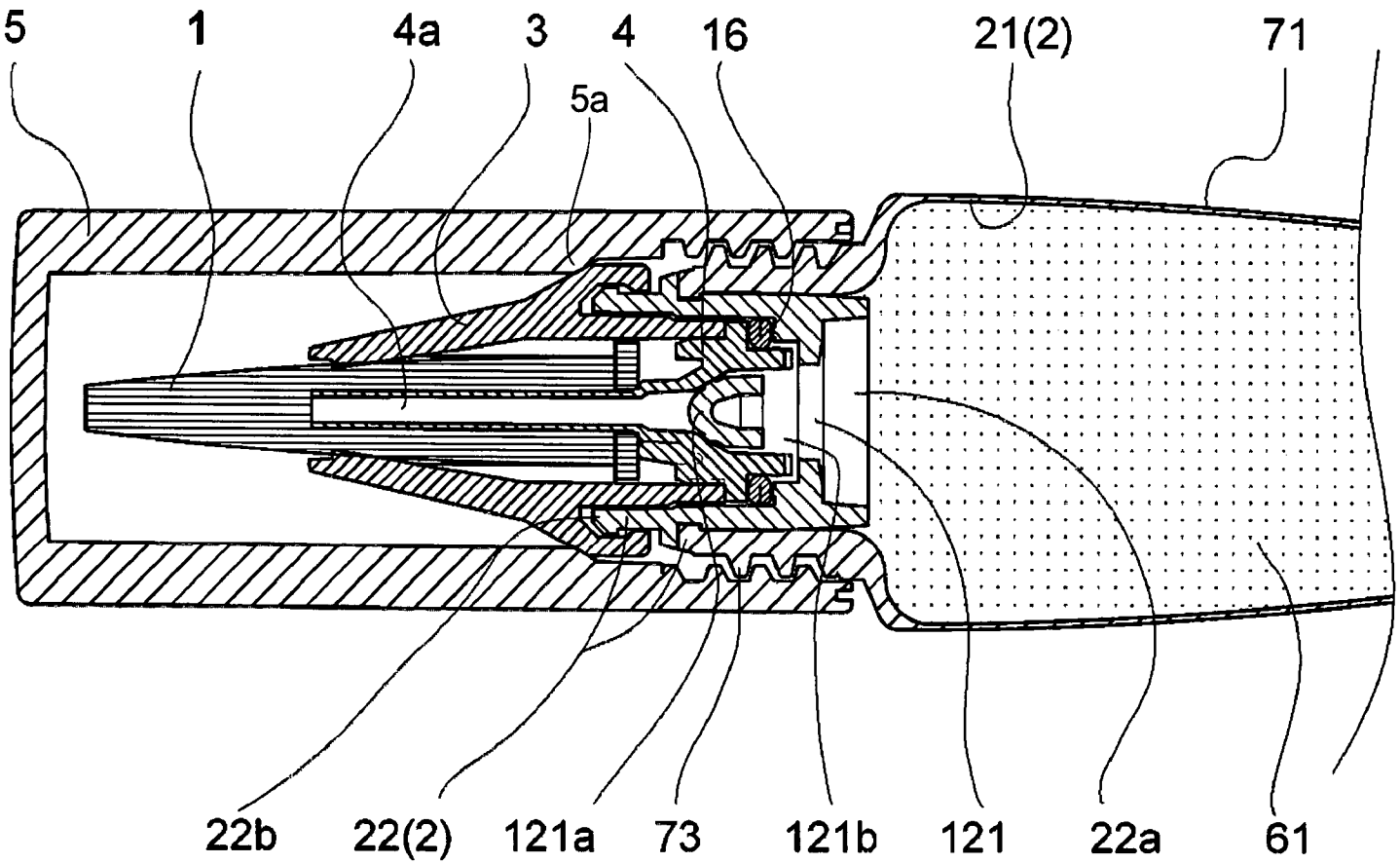
FIG. 13 is a cross-sectional view showing the entire configuration of the container with an application tool according to Embodiment 3 of the present invention (when the cap is attached)
Figure 14:
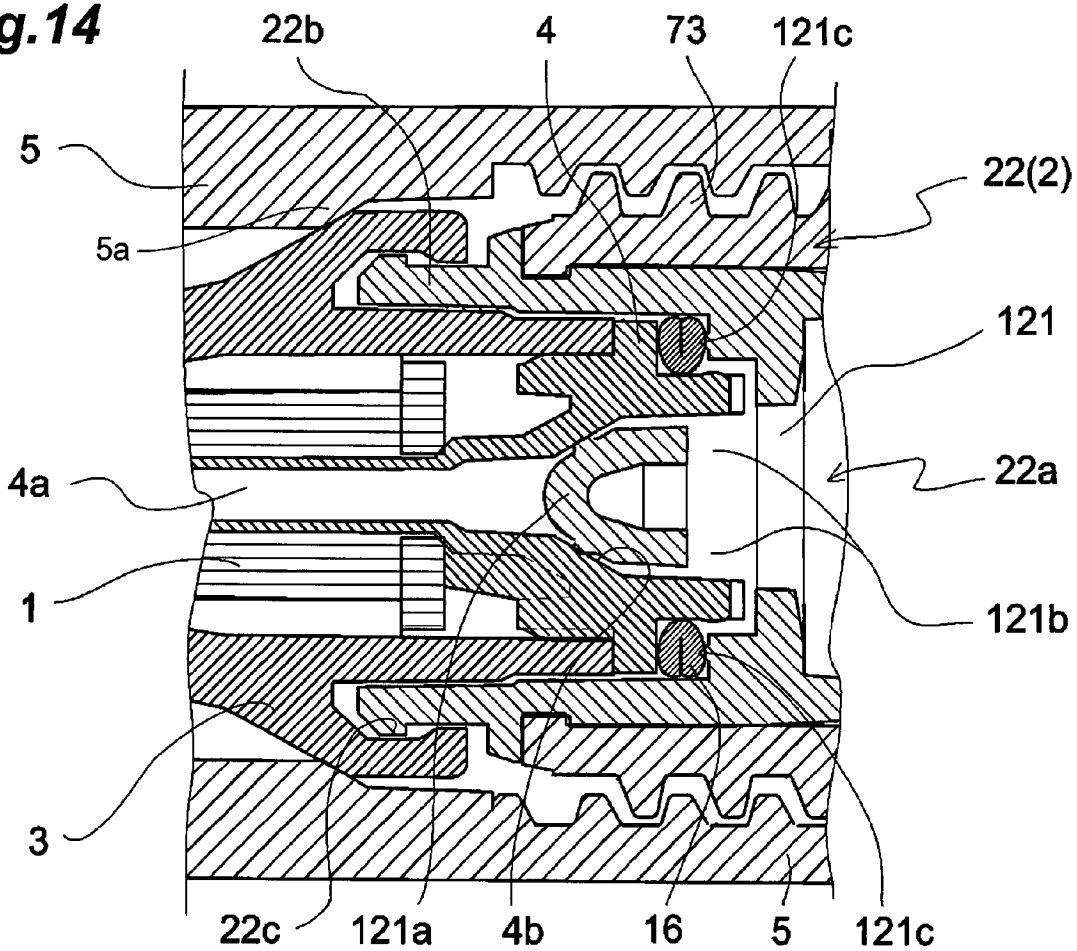
FIG. 14 is a cross-sectional view showing a partial configuration of the same container (when the cap is attached)
Figure 15:
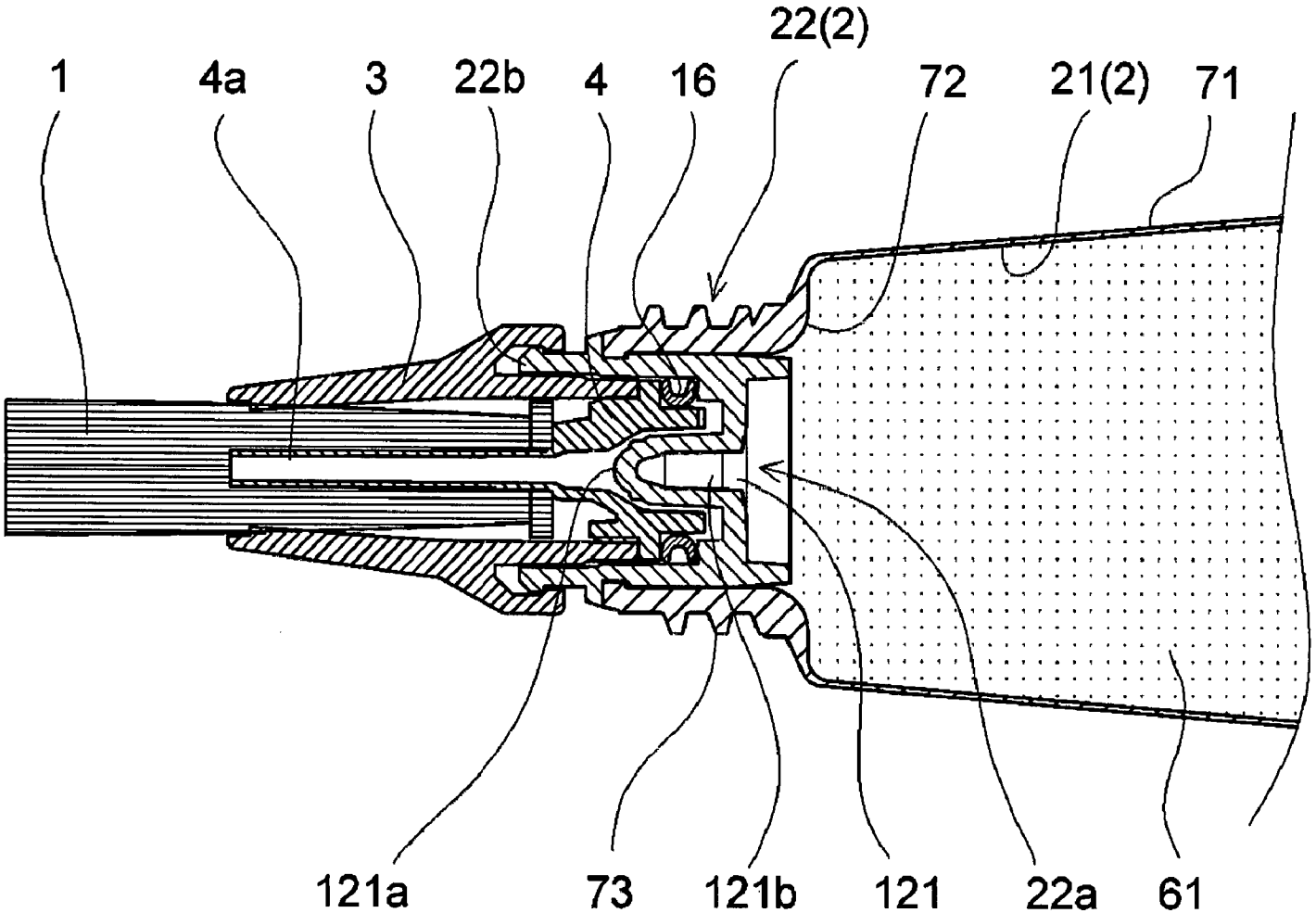
FIG. 15 is a cross-sectional view showing the entire configuration of the same container (when the cap is removed)
Figure 16:
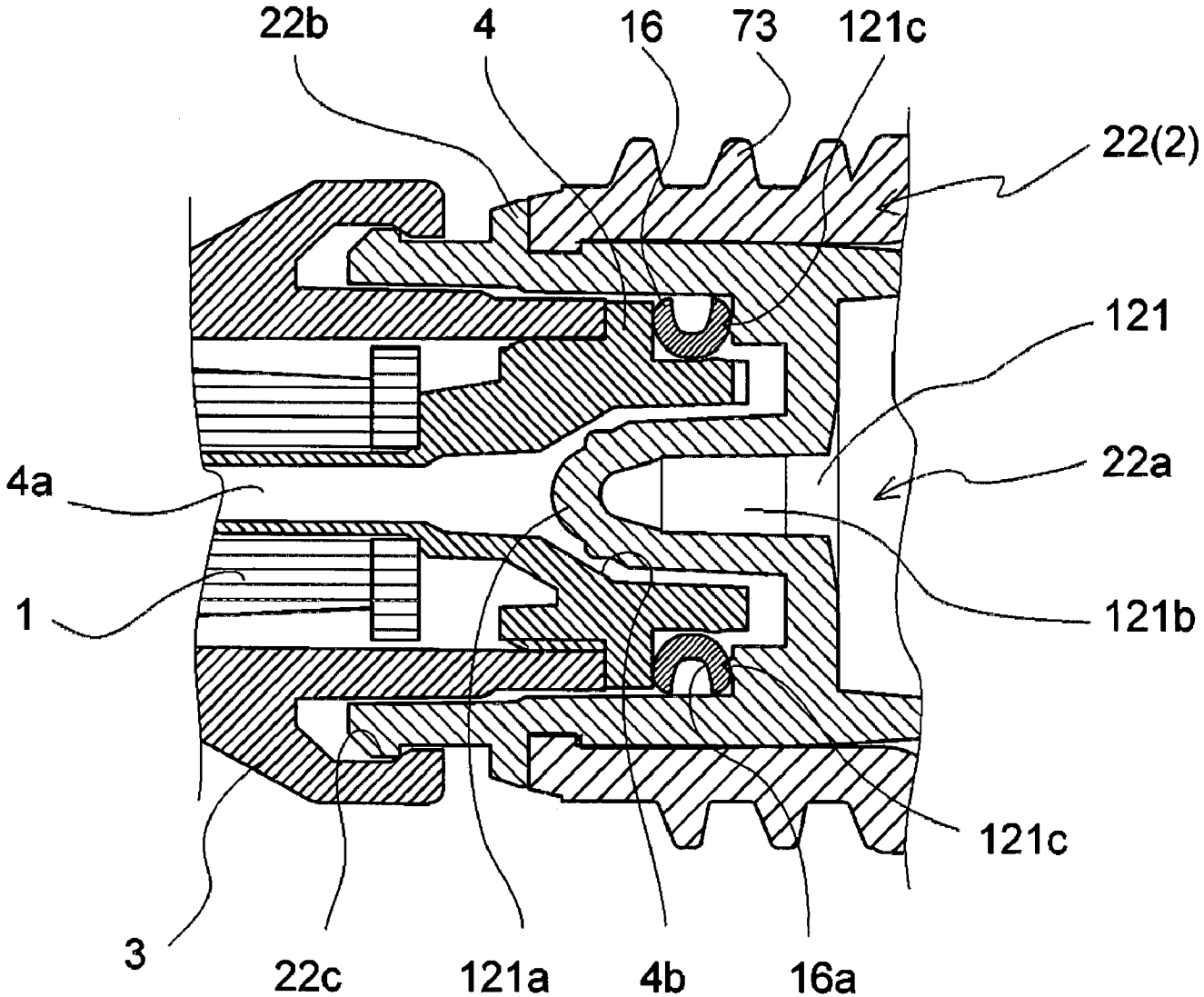
FIG. 16 is a cross-sectional view showing a partial configuration of the same container (when the cap is removed)
Figure 17:
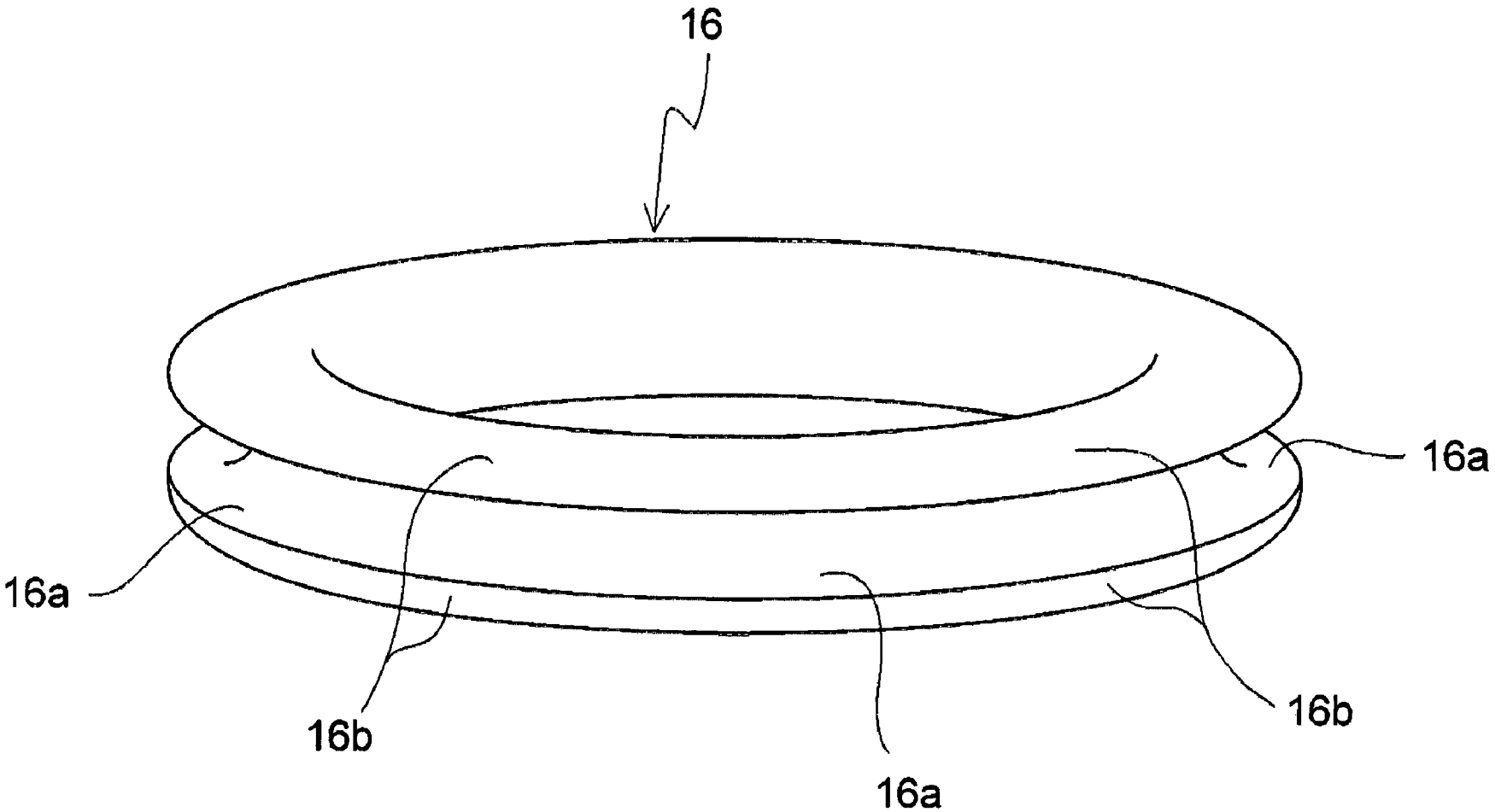
FIG. 17 is a perspective view showing the external configuration of a ring-shaped elastic member.
Figure 18:
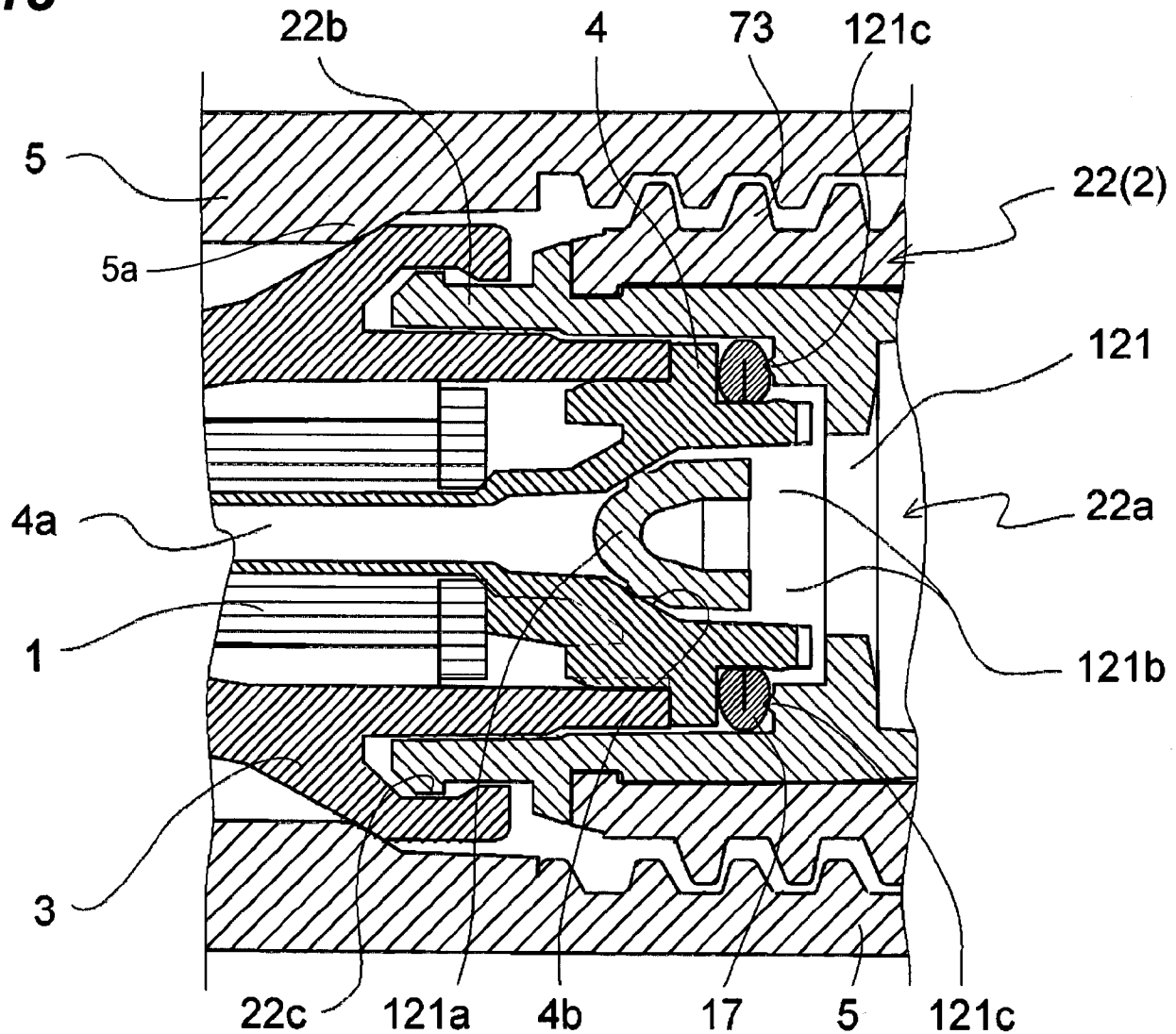
FIG. 18 is a cross-sectional view showing another partial configuration of the same container (when the cap is attached)
Figure 19:
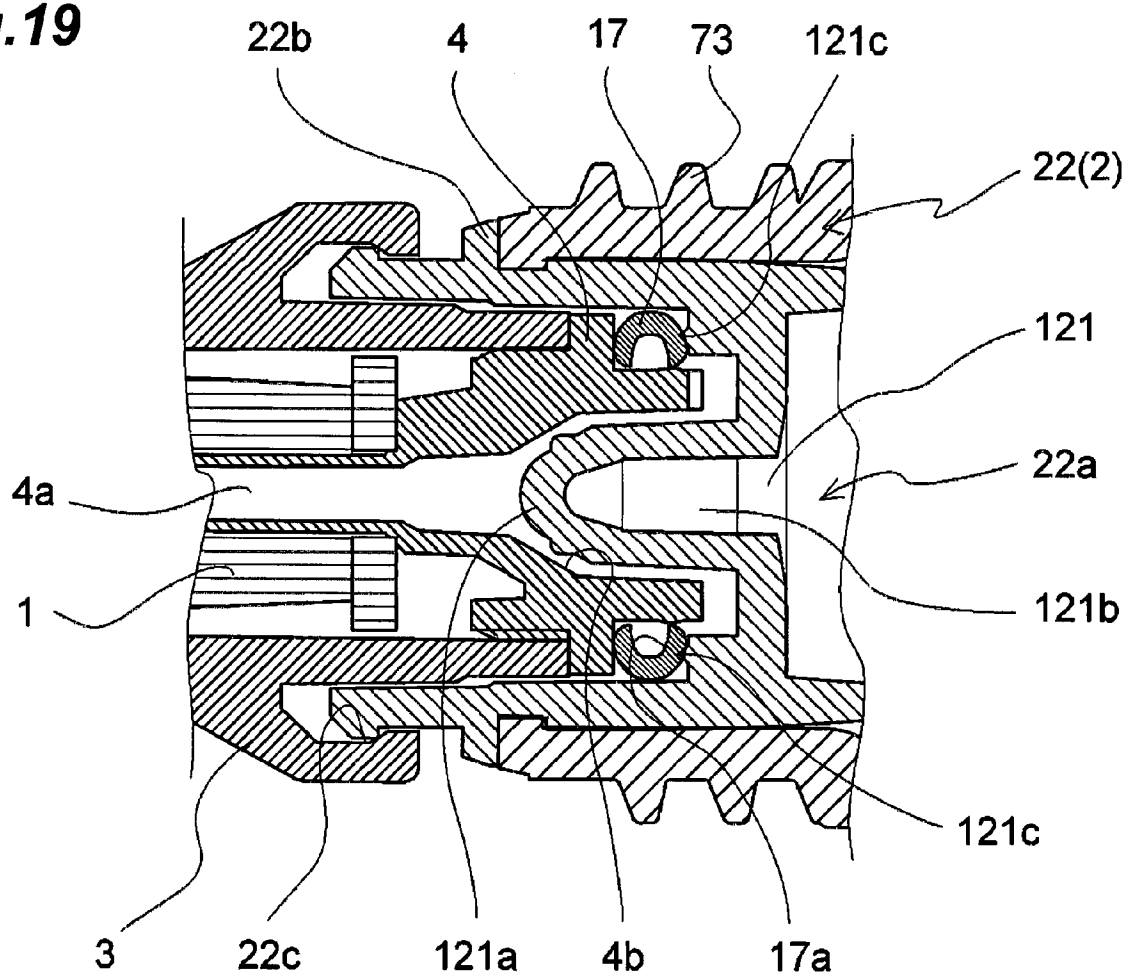
FIG. 19 is a cross-sectional view showing another partial configuration of the same container (when the cap is removed)
Figure 20:
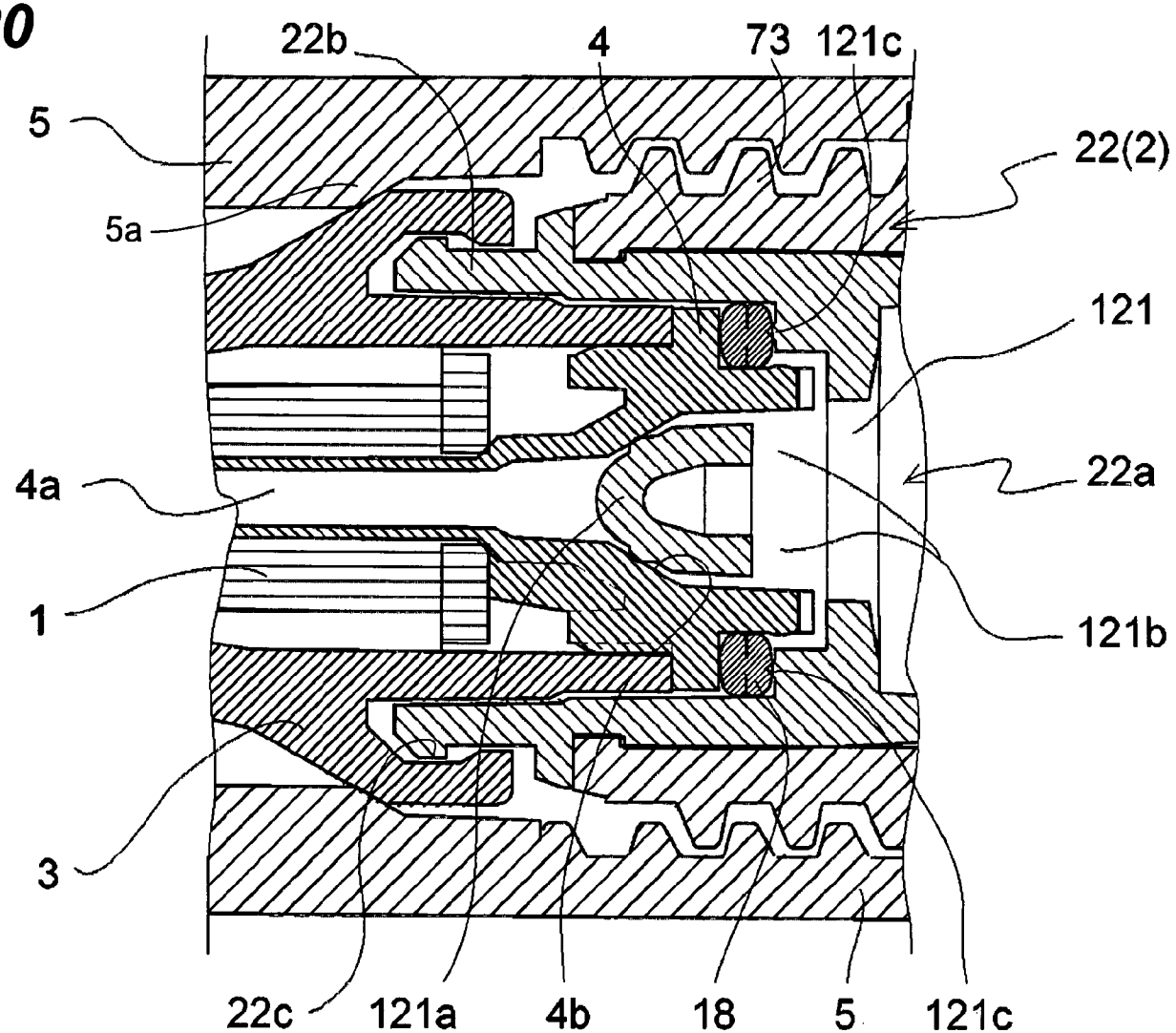
FIG. 20 is a cross-sectional view showing another partial configuration of the same container (when the cap is attached)
Figure 21:
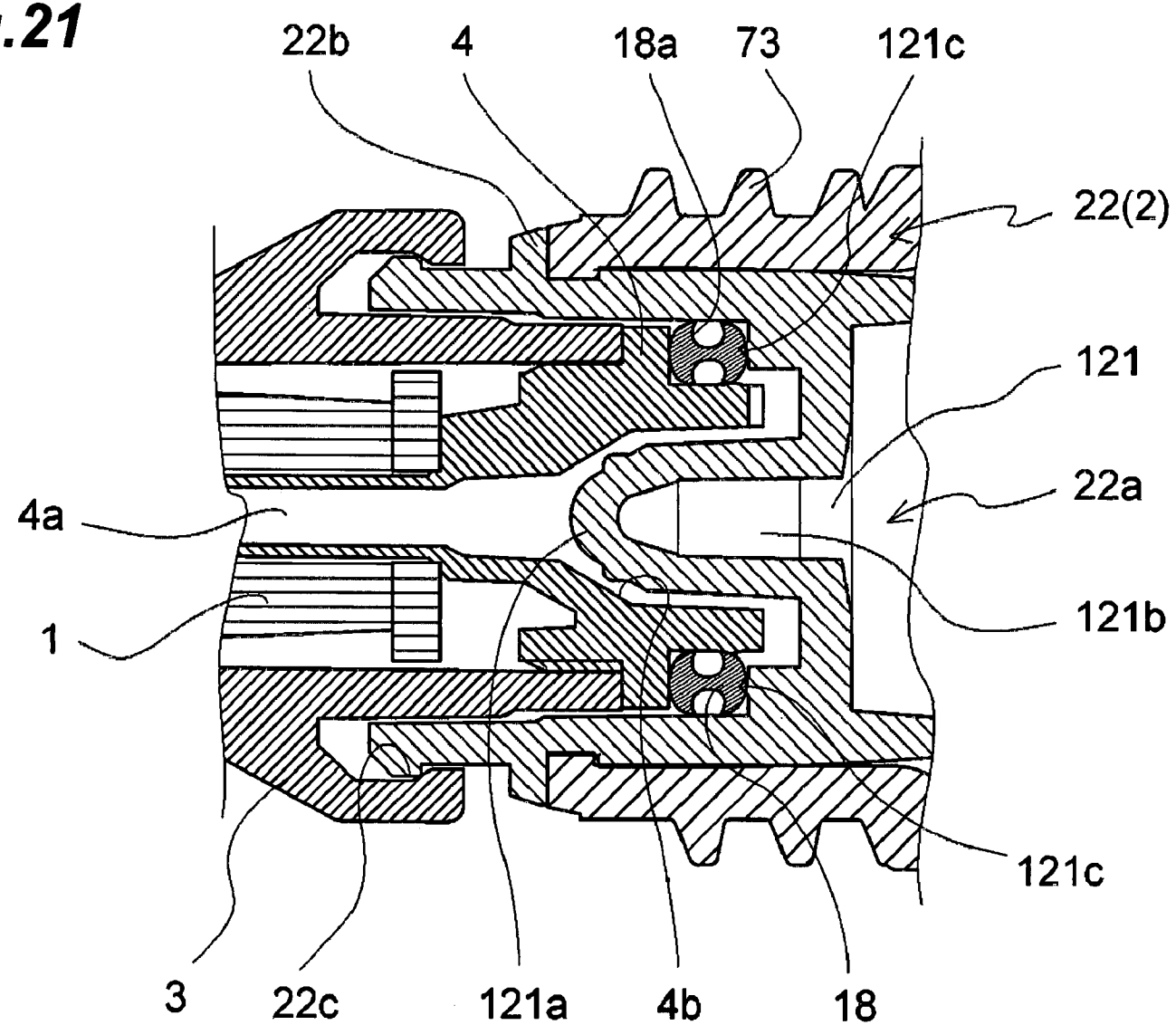
FIG. 21 is a cross-sectional view showing another partial configuration of the same container (when the cap is removed).

FIG. 13 is a cross-sectional view showing the entire configuration of the container with an application tool according to Embodiment 3 of the present invention (when the cap is attached), FIG. 14 is a cross-sectional view showing a partial configuration of the same container (when the cap is attached), FIG. 15 is a cross-sectional view showing the entire configuration of the same container (when the cap is removed), FIG. 16 is a cross-sectional view showing a partial configuration of the same container (when the cap is removed), FIG. 17 is a perspective view showing the external configuration of a ring-shaped elastic member, FIG. 18 is a cross-sectional view showing another partial configuration of the same container (when the cap is attached), FIG. 19 is a cross-sectional view showing another partial configuration of the same container (when the cap is removed), FIG. 20 is a cross-sectional view showing another partial configuration of the same container (when the cap is attached), and FIG. 21 is a cross-sectional view showing another partial configuration of the same container (when the cap is removed).

Structural elements similar to those in Embodiment 1 are denoted by the same symbols as in Embodiment 1, and detailed descriptions thereof are omitted herein.

The container with an application tool in Embodiment 3 has a different configuration from Embodiment 1 in that it comprises a ring-shaped elastic member 16 that has a special cross-sectional shape, as shown in FIGS. 13 through 16.

The ring-shaped elastic member 16 herein has a circular groove 16*a* formed in the outer peripheral surface. This ring-shaped elastic member 16 is capable of elastically deforming to a state in which the groove 16*a* is substantially closed off when the cap 5 is attached to the main body 2.

In other words, a groove 16*a* is formed in a concave shape around the entire circumference of the central section in the outer peripheral surface along the axial direction in the ring-shaped elastic member 16 of Embodiment 3, as shown in FIG. 17, whereby side wall parts 16*b* that protrude outward are provided on either side of the groove 16*a* at the opposing top and bottom sections, and the elastic state can be collapsed into a state wherein the opposing inner surfaces of the side wall parts 16*b* draw near to, or come into contact with, each other when the cap 5 is attached to the main body 2.

A groove 16*a* formed into a special shape herein must be formed in the ring-shaped elastic member 16 because a container with an application tool in which an effective configuration can be obtained with a ring-shaped elastic member that can be manufactured with a wider range of materials is made possible by forming the ring-shaped elastic member 16 into a shape that allows the distance over which the holder 3 moves to be markedly increased. Therefore, instead of the ring-shaped elastic member 16 that has a groove 16*a* formed in a state wherein the hole opens facing only outward, it is possible to use a ring-shaped elastic member 17 that has a groove 17*a* formed in a state wherein the hole opens facing only inward, such as the one shown in FIGS. 18 and 19, a ring-shaped elastic member 18 that has a groove 18*a* formed in a state wherein the hole opens facing both inward and outward, such as the one shown in FIGS. 20 and 21, or another ring-shaped elastic member, as long as the ring fulfills such roles.

Specifically, instead of a ring-shaped elastic member composed of synthetic rubber, which is a general-purpose product, it is possible to use one that can be manufactured from a relatively hard material whereby it has been difficult to ensure the distance over which the holder moves with a cross-sectional elliptical shape, whereby the ring-shaped elastic member can be manufactured from a wider range of materials.

Specifically, the container with an application tool according to Embodiment 3 not only makes it possible to merely obtain an effective configuration, but also makes it possible to obtain an effective configuration with a ring-shaped elastic member that can be manufactured from a wider range of materials, similar to the container with an application tool according to Embodiment 2.

The present invention is not limited to the embodiments described above, and various modifications are possible. For example, in addition to a brush (bristles) 1 containing a bundle of polyester fibers designed to taper towards the end, the coating member may also be a sponge; a porous material composed of polyethylene, polypropylene, polyurethane, or the like; a felt material containing a bundle of polyester or other such fibers bonded with an adhesive; or a material wherein a plurality of fibers is grafted by flocking or the like into the surface of a pipe member provided with a centrally disposed hole and molded from a thermoplastic elastomer or the like.

The invention claimed is:

1. A container with an application tool, comprising: a main body comprising a storage part for storing liquid substances and a neck portion having a communicating port that is communicated with the storage part; an application tool head whose back end is inserted in the neck part and that is axially movably connected to the neck part; a valve scat provided to the back end of the application tool head; a partitioning wall that is provided in the neck part and that partitions the communicating port; a valve body for the valve seat that is provided so as to protrude forward from the partitioning wall and that has a lead-out hole for leading out the liquid substances; and an O-ring elastic member for a water tight connection is provided between a surface on the partitioning wall that supports the elastic member and the application tool head; wherein the elastic member urges the application tool head so that the valve seat separates from the valve body; and the elastic member elastically deforms so that the valve seat is in proximity or in contact with the valve body when the application tool head is pressed backward.

2. The container with an application tool according to claim 1, wherein the application tool head comprises: a cylindrical holder; a coating member held in the holder; and a pipe member whose back part is fitted into the holder and whose front part is inserted into the coating member, wherein the valve seat is provided to the back part of the pipe member.

3. The container with an application tool according to claim 2, further comprising: a cap that has an engaging part for pushing the application tool head backward and that is attached to the neck part of the main body, wherein the elastic member elastically deforms so that the valve seat is in proximity or in contact with the valve body due to the application tool head being pushed backward by the engaging part when the cap is attached to the neck part; and the elastic member returns to the original state and the valve seat separates from the valve body when the cap is removed from the neck part.

4. The container with an application tool according to claim 3, wherein the thickness of the elastic member in the direction along the central axis is greater than the thickness in the direction perpendicular thereto.

5. The container with an application tool according to claim 3, wherein a circular groove is formed in at least one of the inner peripheral surface and the outer peripheral surface of the elastic member.

6. The container with an application tool according to claim 2, wherein the thickness of the elastic member in the direction along the central axis is greater than the thickness in the direction perpendicular thereto.

7. The container with an application tool according to claim 2, wherein a circular groove is formed in at least one of the inner peripheral surface and the outer peripheral surface of the elastic member.

8. The container with an application tool according to claim 2, comprising a protrusion provided in continuity with the top of the surface on the partitioning wall that supports the elastic member.

9. The container with an application tool according to claim 1, further comprising: a cap that has an engaging part for pushing the application tool head backward and that is attached to the neck part of the main body, wherein the elastic member elastically deforms so that the valve seat is in proximity or in contact with the valve body due to the application tool head being pushed backward by the engaging part when the cap is attached to the neck part; and the elastic member returns to the original state and the valve seat separates from the valve body when the cap is removed from the neck part.

10. The container with an application tool according to claim 9, wherein the thickness of the elastic member in the direction along the central axis is greater than the thickness in the direction perpendicular thereto.

11. The container with an application tool according to claim 9, wherein a circular groove is formed in at least one of the inner peripheral surface and the outer peripheral surface of the elastic member.

12. The container with an application tool according to claim 9, comprising a protrusion provided in continuity with the top of the surface on the partitioning wall that supports the elastic member.

13. The container with an application tool according to claim 1, wherein the thickness of the elastic member in the direction along the central axis is greater than the thickness in the direction perpendicular thereto.

14. The container with an application tool according to claim 13, comprising a protrusion provided in continuity with the top of the surface on the partitioning wall that supports the elastic member.

15. The container with an application tool according to claim 13, wherein the elastic member has a substantially elliptical cross section.

16. The container with an application tool according to claim 15, comprising a protrusion provided in continuity with the top of the surface on the partitioning wall that supports the plastic member.

17. The container with an application tool according to claim 1, wherein a circular groove is formed in at least one of the inner peripheral surface and the outer peripheral surface of the elastic member.

18. The container with an application tool according to claim 17, comprising a protrusion provided in continuity with the top of the surface on the partitioning wall that supports the elastic member.

19. The container with an application tool according to claim 1, comprising a protrusion provided in continuity with the top of the surface on the partitioning wall that supports the elastic member.

20. The container with an application tool according to claim 1, wherein the neck part has a stopper that prevents the application tool head from being released from the neck part.

* * * * *